United States Patent [19]

Gurstein

[11] Patent Number: 5,001,806

[45] Date of Patent: Mar. 26, 1991

[54] KIT FOR FABRIC CLEANING DEVICE

[75] Inventor: Bernard Gurstein, Hayden Lake, Id.

[73] Assignee: U.S. Products Inc., Hayden Lake, Id.

[21] Appl. No.: 450,202

[22] Filed: Dec. 13, 1989

[51] Int. Cl.[5] ..... A47L 9/02

[52] U.S. Cl. ..... 15/322; 15/415 R; 15/414; 15/257 A

[58] Field of Search ..... 15/257 A

[56] References Cited

U.S. PATENT DOCUMENTS

| | | | |
|---|---|---|---|
| 2,091,290 | 8/1937 | Replogle . | |
| 3,244,437 | 4/1966 | Belicka et al. | 15/414 X |
| 3,759,766 | 9/1973 | Mangus | 15/414 X |
| 4,083,077 | 4/1978 | Knight et al. | 15/321 |
| 4,127,913 | 12/1978 | Monson | 15/321 |
| 4,161,802 | 7/1979 | Knight et al. | 15/331 |
| 4,266,317 | 5/1981 | Duda | 15/322 |
| 4,573,237 | 3/1986 | Kochte et al. | 15/415 R X |
| 4,597,124 | 7/1986 | Williams, III et al. | 8/158 |
| 4,766,638 | 8/1988 | McDowell | 15/327 |

FOREIGN PATENT DOCUMENTS

| | | | |
|---|---|---|---|
| 0114926 | 8/1984 | European Pat. Off. | 15/322 |
| 2704308 | 8/1978 | Fed. Rep. of Germany | 15/322 |
| 3136477 | 3/1983 | Fed. Rep. of Germany | 15/322 |
| 1520761 | 8/1978 | United Kingdom | 15/322 |

*Primary Examiner*—Ernest G. Cusick

*Attorney, Agent, or Firm*—Browdy and Neimark

[57] ABSTRACT

A fabric cleaning apparatus including a vacuum hose and a liquid spray nozzle is provided with a cleaning wand having a universal head support for accepting any one of a series of different sized and/or shaped cleaning head attachments, each being adapted for a particular fabric cleaning function.

5 Claims, 3 Drawing Sheets

KIT FOR FABRIC CLEANING DEVICE

FIELD OF THE INVENTION

The present invention relates to the cleaning of carpets, upholstery, drapes and the like and more particularly to a hand tool kit including a single wand with exchangeable cleaning heads adaptable for different types of cleaning.

BACKGROUND OF THE INVENTION

Portable wet and dry cleaning devices for the cleaning of carpets, upholstery, drapes, ceilings and the like are commonly in use by professional cleaners and may also be available for rental in some cases by non-professionals. Equipment of this general type is shown in the patent literature in, for example, the U.S. Pat. No. 4,597,124 of Williams et al, the U.S. Pat. No. 4,266,317 of Duda, the U.S. Pat. No. 4,161,802 of Knight et al, and the U.S. Pat. No. 4,127,913 of Monson. Commercial and household vacuum cleaners such as shown in the McDowell U.S. Pat. No. 4,766,638 do not serve the purpose of these devices, nor do floor cleaning and polishing devices such as shown by the Replogle U.S. Pat. No. 2,091,290.

While many of the aforementioned devices are constructed for one type of cleaning only, e.g. for cleaning of pleated drapes (e.g. the Knight et al device) for for cleaning upholstery (e.g. the Williams et al device), or for cleaning floors (e.g. the Duda device), other equipment of this type is adapted to use plural wands having different heads adapted for particular types of cleaning, e.g. an all-in-one drapery, upholstery, ceiling, carpet cleaning machine sold under the trademark "The Ultimate" by U.S. Products, Inc.. This device uses a number of interchangeable wands, each having a head adapted for cleaning a particular object, e.g. drapes, carpet, etc. However, even for advanced equipment of this type, it is a nuisance for the professional cleaner to have to carry different vacuum cleaning wands each having its own specialized head, and to change these as the object to be cleaned changes

SUMMARY OF THE INVENTION

It is therefore an object of the invention to overcome deficiencies in the prior art, such as indicated above.

It is another object of the invention to improve the ease and effectiveness in switching from the cleaning of one type of object to another.

It is a further object of the invention to provide simplified and easier-to-use cleaning equipment for cleaning carpets, ceilings, upholstery, drapes, etc.

It is still another object of the invention to provide a hand tool kit for such cleaning equipment including a simple combination liquid spray wand and vacuum hose having a plurality of exchangeable working heads all of which interchangeably fit on a universal base at the distal end of the vacuum hose/wand.

BRIEF DESCRIPTION OF DRAWING

These and other objects and the nature and advantages of the present invention will be more apparent from the following detailed description of a preferred embodiment of the present invention described in conjunction with the drawings wherein.

DETAILED DESCRIPTION OF THE INVENTION

Figure 1:
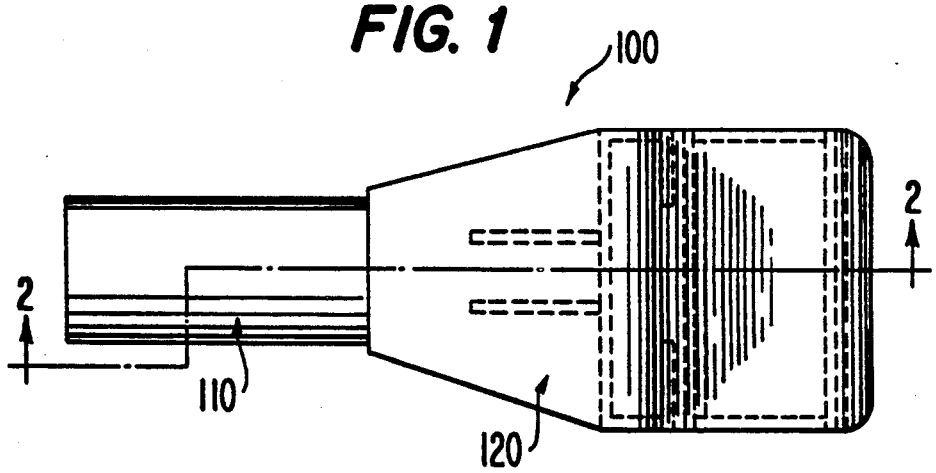
FIG. 1 is a top plan view of a base unit in accordance with the present invention.
Figure 2:
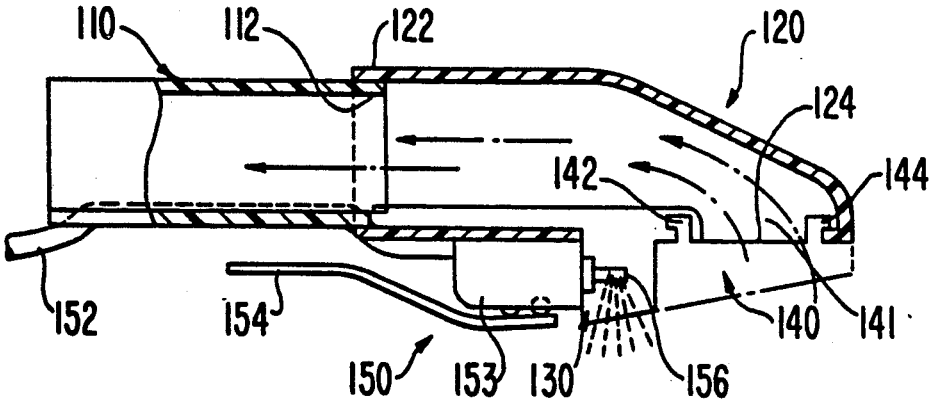
FIG. 2 is a section along line 2—2 of FIG. 1.
Figure 3:
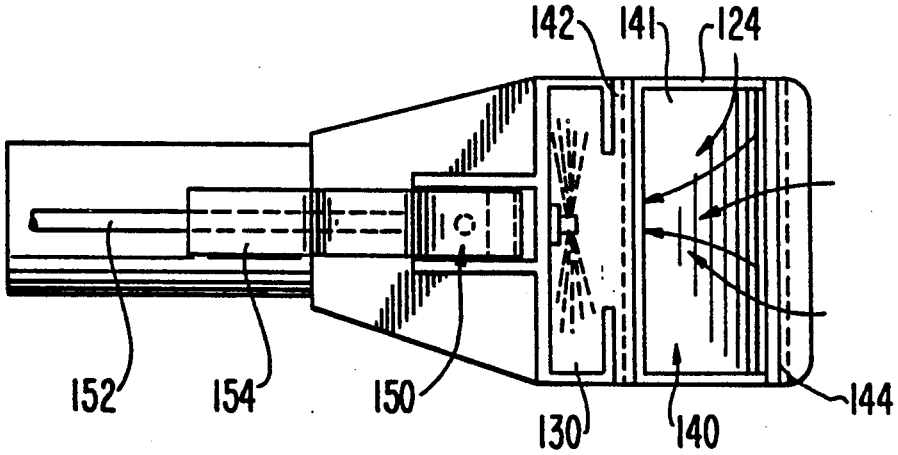
FIG. 3 is a bottom plan view of the base unit of FIGS. 2 and 3.

Referring now to the drawings, FIGS. 1-3 show the spray and vacuum wand assembly 100 of the present invention including a hollow handle portion 110 which serves as a first hollow hose connecting section for connecting to a large diameter hose from a vacuum source in a base unit (not shown), and a universal head support 120 which serves as a second hollow section. Both portions 110 and 120 are hollow and have interiors which are in fluid communication with one another. The junction between the forward part 112 of the hollow handle portion 110 and the rearward part 122 of the universal head support 120 is preferably formed to permit relative rotating motion of the head support 120 about the longitudinal axis of the handle portion 110. The spray and vacuum wand assembly 100 is adapted to be hand-held while being moved in up and down motions along the major surface areas of drapery material, or back and forth motions over the exterior surfaces of upholstery or other fabric surfaces.

As seen in FIG. 2, the top side of the universal head support 120 is a continuous and streamlined closed wall. The bottom side of hand support 120 is divided into two discrete sections or chambers; a first spray section 130 and a second vacuum port section 140 located forwardly of the spray section. A liquid spray unit 150 is mounted at the underside of the head support 120 rearwardly of the vacuum port section. The spray unit includes a hose 152 for conveying a cleaning fluid (such as a solvent, stain remover, aqueous detergent solution, etc.) from a base unit (not shown) to the spray unit, a valve housing 153, a trigger-type actuator lever 154 and a nozzle 156 provided with one or more downwardly directed nozzle openings for emitting a spray of the cleaning fluid from the base unit. The spray unit 150 is carried as an integral part of the head support 120. It is to be understood that actuation of the spray unit as to duration and timing of the spraying is under the control of the operator during the cleaning process undertaken with the apparatus of the present invention.

Referring again to FIGS. 2 and 3, the lower side 124 of head support 120 at a region forwardly of the spray section is seen to define a generally rectangular inlet 141 of the port section 140. Two laterally extending locking channels 142, 144 are disposed on forward and rearward sides of the vacuum inlet 141. These locking channels are parallel to one another and extend perpendicular to the longitudinal axis of the tubular handle portion 110. Each channel is L-shaped, (see FIGS. 2 and 4) and includes a substantially vertical leg portion and a substantially horizontal foot portion, with the foot portions of the channels extending in opposite directions. This pair of channels facilitates a sliding connection or disconnection of various cleaning heads (see FIGS. 4–9 and a more detailed disclosure below of several examples of such heads) having specific configurations adapted for specific cleaning tasks. It is to be understood that the spray and vacuum wand assembly 100 shown in FIGS. 1–3 (as well as FIGS. 4, 10 and 11) is capable of quickly and easily accepted any of the cleaning heads disclosed in this application or any other cleaning heads having a structure and configuration which would be obvious to a person of ordinary skill in this art in view of the teachings embodied in this disclosure. In this manner, the spray and vacuum wand assembly of the present invention provides a universal connection support for any of the cleaning heads disclosed herein.

Figure 4:
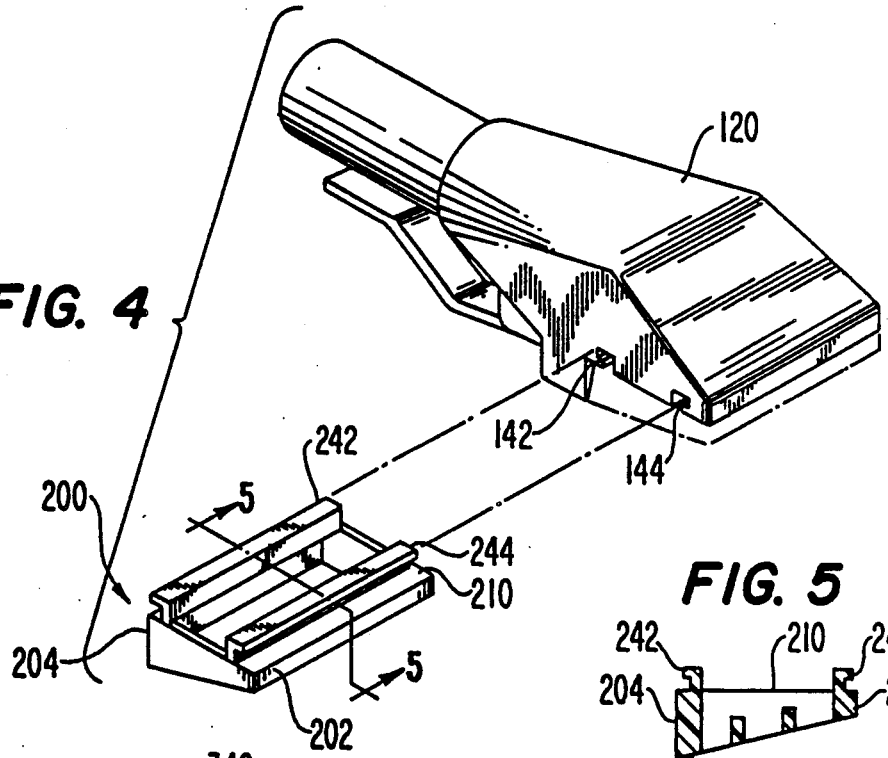
FIG. 4 is an exploded perspective view of the base unit showing the insertion of a first easily exchangeable head adapted for use in cleaning upholstery.
Figure 5:
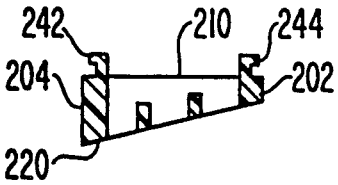
FIG. 5 is a section along line 5—5 of FIG. 4.
Figure 6:
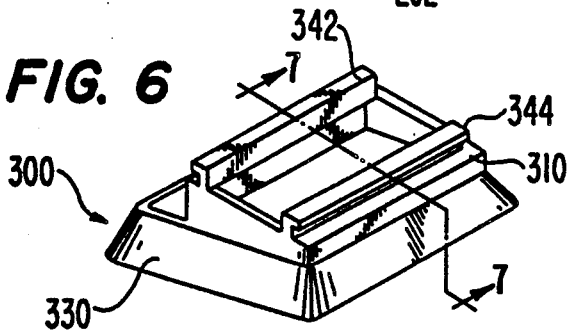
FIG. 6 is a perspective view of a slightly larger (second) head adapted for insertion into the base unit and adapted for use in cleaning drapes and/or upholstery.
Figure 7:
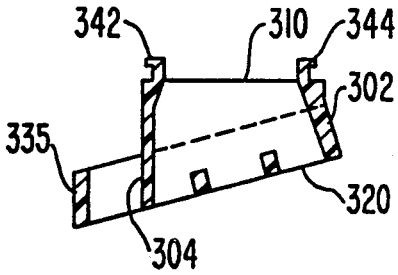
FIG. 7 is a section along line 7—7 of FIG. 6.
Figure 8:
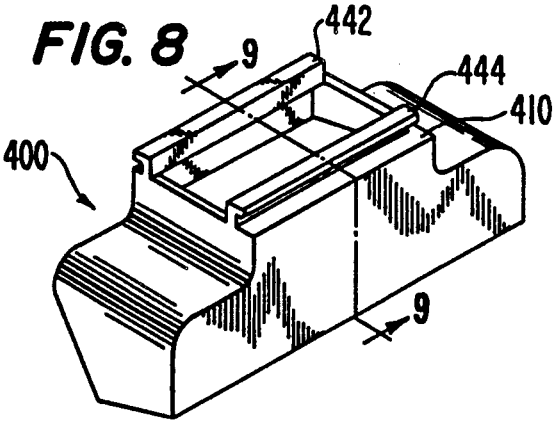
FIG. 8 is a perspective view of a still larger (third) head adapted for insertion into the base unit and adapted for use in cleaning drapes and/or carpeting.
Figure 9:
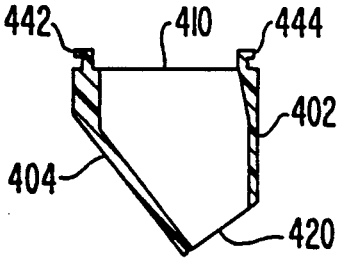
FIG. 9 is a section view along line 9—9 of FIG. 8.

Three cleaning heads (FIGS. 4–9) are presented by way of example only and are adapted for use with the spray and vacuum wand assembly 100 of the present invention. A first head 200 is shown in FIGS. 4 and 5; a second head 300 is shown in FIGS. 6 and 7; and a third head is shown in FIGS. 8 and 9. Each of the disclosed cleaning heads includes a pair of rail members of a size and configuration adapted for facile insertion into, and removal from, the channels 142 and 144 in the universal head support 120 of the spray and vacuum wand assembly 100. The pair of rail members (242, 244 in FIGS. 4 and 5; 342, 344 in FIGS. 6 and 7; and 442, 444 in FIGS. 8 and 9) are disposed parallel to one another and spaced apart a distance corresponding to the distance between the channels 142, 144. Each rail member is L-shaped in cross section, and includes a substantially vertical leg portion and a substantially horizontal foot portion with the leg portion being substantially perpendicular, and the foot portion being substantially parallel, to the upper surface of the respective cleaning head so that upon insertion of the rail members of any cleaning head in the channels universal head support 120 of the spray and vacuum wand assembly 100, adjacent surfaces of the cleaning head and the head support portion 120 meet in tight-fitting engagement so as to provide an essentially vacuum tight interfit.

Each of the three disclosed cleaning heads 200, 300, 400 comprises a hollow housing having a top surface 210, 310, 410 situated in a first plane from which the leg portions of the pair of rail members extend upwardly and a bottom surface 220, 320, 420 situated in a second plane. The bottom surface of each of the cleaning heads disclosed in this application are normally disposed at an angle of less than 90 degrees relative to the first plane.

In the first embodiment (FIGS. 4 and 5), the walls of the cleaning head housing extend from the top surface 210 downwardly to the bottom surface 220, and the front wall 202 is of shorter height than the rear wall 204. The small size and bottom surface slope make this head 200 especially suitable for cleaning upholstery.

In the second embodiment (FIGS. 6 and 7), the head housing has essentially the same configuration as the housing of the first head 200 and includes a front wall 302, but also includes a skirt 330 formed about the lower region of the housing. A skirt extension 335 extends rearwardly from the rear wall 304 of the skirt 330 and defines between the rear wall and the skirt rear wall a secondary skirt for augmenting the structural strength of the cleaning head, while increasing the volume of the spray chamber of the wand assembly, thereby influencing the degree of saturation of material being treated via the sprayed fluid emitted from the spraying device 150 carried by the wand assembly. This head 300 is shaped and sized so as to be especially suitable for cleaning upholstery and/or drapes.

The third (FIGS. 8 and 9) cleaning head 400 comprises a single hollow housing including top and bottom surfaces 410, 420 having the same orientation to the side walls and to one another as the first embodiment of the cleaning head (shown in FIGS. 4 and 5). The cleaning head 400 is further provided with a front wall 402 which is disposed perpendicularly to the top surface 410, and a rear wall 404. Both the front and rear walls have portions which are parallel to one another; however, the rear wall also includes a further portion which is disposed at an acute angle to the top surface and which meets the bottom surface at a substantially right angle. As most clearly seen in FIG. 9, the crosssection area of the top opening of cleaning head housing 400 is substantially greater than the bottom opening or mouth of the housing 400. The head 400 is shaped and sized for efficient cleaning of drapes and/or carpets.

Figure 10:
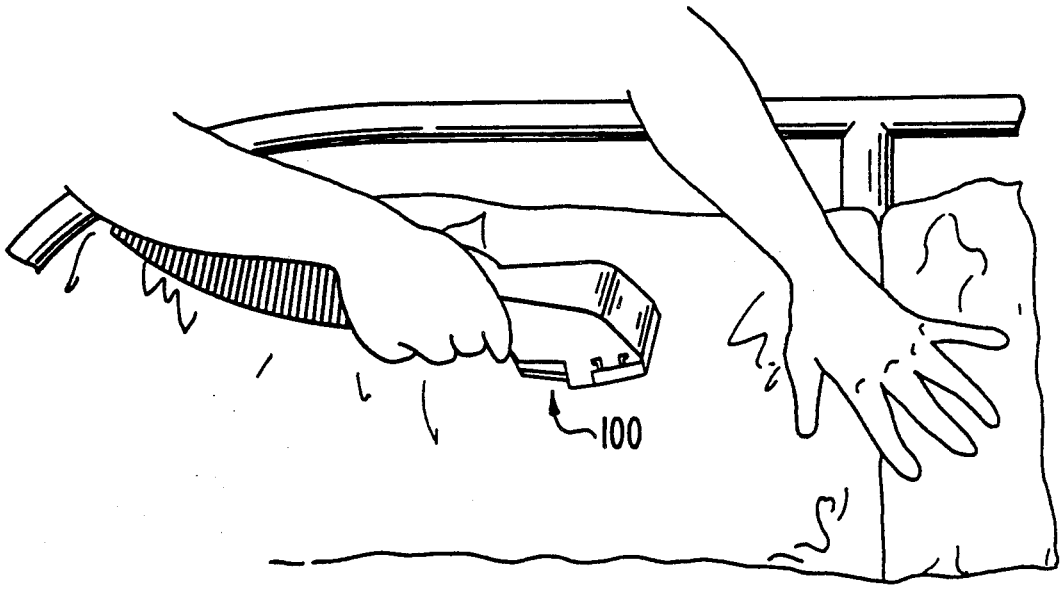
FIG. 10 is a perspective view showing the device of the present invention in use in the cleaning of upholstery.
Figure 11:
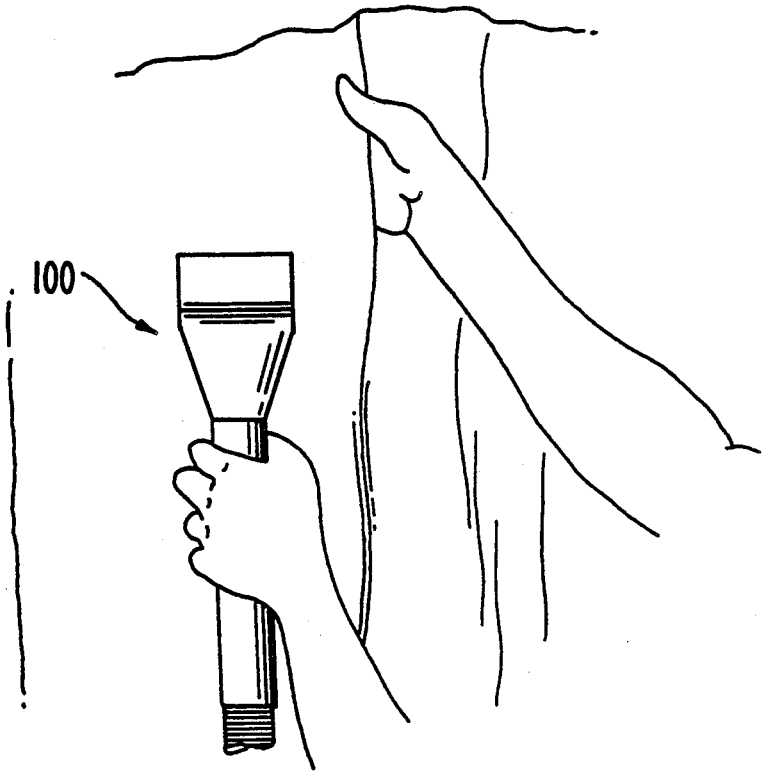
FIG. 11 is a perspective view showing the device of the present invention in use in the cleaning of drapes.

It is to be understood that the disposition of the bottom surface of the cleaning heads at an acute angle to the top surface facilitates the ease of use of the wand assembly of the present invention, and further increases the effectiveness of the cleaning process. As seen in FIGS. 10 and 11, the user of the Wand assembly 100 need only stretch, smooth or otherwise make taut the fabric to be cleaned, and then, with the wand assembly grasped in his other hand, move the wand assembly and attached preselected cleaning head in reciprocating motions over the fabric e.g. right (forwardly) to left (rearwardly) as seen in FIG. 10 or up (forwardly) and down (rearwardly) as seen in FIG. 11. The present invention contemplates use of all three exemplary cleaning heads in the cleaning of upholstery, drapes, carpets, fabric walls and the like. The head 400 (FIGS. 8 and 9) is particularly useful for the cleaning of draperies due to its narrow mouth because draperies have no support or backing, as do other types of furniture or carpet fabrics; thus even if the drape is held taut during cleaning, when the cleaning head is applied, the drapery surface to be cleaned will flex or otherwise move away from the conventional cleaning head and thereby prevent the application of an appropriate pressure by the cleaning head against the drapery surface to create the contact between the head bottom surface and the drapery surface which is required to effect suction of cleaning fluids and/or dirt from the drapery surface. The bottom surface 420 forming a narrow mouth of the head 400 obviates this problem.

In use, the hand-held wand assembly 100 is grasped by the user and is moved with an appropriate motion across the fabric to be cleaned. As the wand assembly is moved, the user pulls the trigger-type actuator level 154 on the spray unit 150 so that cleaning fluid can be transported from the base unit (not shown) to the fabric through the spray nozzle 156. The cleaning fluid is directed onto the fabric through the nozzle 156 in a fan-shaped spray at a location directly behind the vacuum chamber of the wand assembly. As the wand assembly is continuously moved by the user, the opening at the lower surface of the vacuum chamber, which is in constant, continuous engagement with the fabric being cleaned, permits the loosening of dirt if preceding the spray unit (i.e. as when the wand assembly is pushed in a forward direction), or the vacuuming of dirt and cleaning fluid (if used) if following the spray unit (i.e. as when the wand assembly is pulled in a rearward direction).

A major advantage of the present invention is the elimination of plural tools normally necessary for a variety of cleaning functions. Thus, according to the invention the operator has only one vacuum wand 100 with a universal head support 120, and a plurality of interchangeable heads 200, 300, 400, etc. as needed, each adapted to its own particular function. Equipment costs are substantially reduced, and the work is made easier for the operator because his kit of tools is lightened and the changing from one tool to another is simplified.

The present invention may, of course, be carried out in other specific ways than those herein set forth without departing from he spirit and essential characteristics of the invention. The embodiments are, therefore, to be considered in all respects as illustrative and not restrictive, and all changes coming within the meaning and equivalency range of the appended claims are intended to be embraced therein.

What is claimed is:

1. In a cleaning wand assembly for use with wet or dry cleaning apparatus including a base unit having cleaning fluid reservoir means and first hose means for supplying cleaning fluid from the reservoir means to the fabric to be cleaned, and vacuum producing means for removing dirt and/or cleaning fluid from the fabric including second hose means for conveying removed substances from the fabric to the base unit, the improvement wherein the cleaning wand assembly comprises:

a first hollow hose-connecting section for attaching the second hose means to the cleaning wand assembly, and a second hollow section coupled to, and fluidly communicating with, said first hollow section, said second hollow section including a first region for supporting a spray unit, a second region located forwardly of said first region having an aperture extending therethrough for communication with the hollow interior of said second hollow section, and depending wall means for dividing said first region from said second region, said second region defining means for receiving and securing a cleaning head attachment including channel means in said second region for engagement with said cleaning head attachment, a spray unit supported at said first region rearwardly of said channel means and including means for connecting said spray unit to said first hose means, valve means, actuator means for actuating said valve means, and a spray nozzle for emitting a spray of cleaning fluid conveyed from said base unit reservoir to said spray unit, and a set of cleaning head attachments interchangeably mountable on said second hollow section, each of said cleaning head attachments having a configuration which differs from the other cleaning head attachments in said set, and each of said cleaning head attachments including rail members configured and sized for interengagement with said channel means so that said cleaning head attachment is securely held in tightfitting engagement with interfitting wall surface of said second region of said wand assembly.

2. The assembly of claim 1, wherein each of said cleaning head attachments have a top surface and a bottom surface, and the top surface and the bottom surface of each said cleaning head attachment are disposed at an acute angle relative to one another.

3. The assembly of claim 1, wherein each of said channel means and said rail members ar L-shaped in cross-section, said channel means and said rail members being provided in parallel pairs, and said channel means extend upwardly from said aperture.

4. The assembly of claim 1, wherein said set of cleaning attachments includes one for assisting in the cleaning and vacuuming of draperies, said one attachment having a hollow housing and including a skirt extending downwardly from said hollow housing and having a rearwardly extending skirt extension for augmenting the structural strength of said attachment and influencing the degree of saturation of the fabric being treated via the cleaning fluid emitted from the spray unit.

5. A cleaning kit for use with an apparatus for cleaning fabric surfaces and including means for spraying a cleaning liquid and means for vacuuming the cleaning liquid from the fabric, said kit comprising a cleaning wand comprising a hollow handle portion and a universal head support defining a vacuum conduit, said universal head support having a single downwardly facing vacuum port, and a cleaning liquid spray nozzle (156) disposed adjacent said vacuum port and adapted to spray cleaning liquid in a downward direction therefrom, said universal head support further comprising channel means for receiving and securing a cleaning head attachment thereto so as to completely cover said vacuum port, and a plurality of cleaning head attachments each of a different size, and each comprising rail members adapted to interengage with said channel means so that each said cleaning head attachment can be received and secured to said universal head support to entirely cover said downwardly facing vacuum port without interfering with said spray nozzle.

* * * * *